US006696913B2

(12) United States Patent
Meuche et al.

(10) Patent No.: US 6,696,913 B2
(45) Date of Patent: Feb. 24, 2004

(54) FERRITE CORE FOR A TRANSFORMER

(75) Inventors: Helko Meuche, Münich (DE); Mauricio Esguerra, Taufkirchen (DE)

(73) Assignee: EPCOS AG, Münich (DE)

( * ) Notice: Subject to any disclaimer, the term of this patent is extended or adjusted under 35 U.S.C. 154(b) by 0 days.

(21) Appl. No.: 09/772,833

(22) Filed: Jan. 30, 2001

(65) Prior Publication Data

US 2002/0158743 A1 Oct. 31, 2002

(30) Foreign Application Priority Data

Nov. 17, 2000 (DE) ..... 100 56 945

(51) Int. Cl.[7] ..... H01F 27/30

(52) U.S. Cl. ..... 336/208; 336/212; 336/225; 336/233; 336/83

(58) Field of Search ..... 336/208, 212, 336/225, 233, 83; 29/602.1

(56) References Cited

U.S. PATENT DOCUMENTS

| | | | | |
|---|---|---|---|---|
| 4,352,081 A | | 9/1982 | Kijima | |
| 4,424,504 A | * | 1/1984 | Mitsui et al. | 336/83 |
| 4,684,882 A | | 8/1987 | Blain | |
| 4,760,366 A | * | 7/1988 | Mitsui | 336/233 |
| 4,887,061 A | * | 12/1989 | Matsumura | 336/178 |
| 4,947,311 A | * | 8/1990 | Peterson | 363/124 |
| 4,978,906 A | | 12/1990 | Herbert et al. | |
| 5,629,589 A | | 5/1997 | Goseberg et al. | |
| 5,991,269 A | | 11/1999 | Williamson et al. | |
| 6,194,795 B1 | | 2/2001 | Muller | |
| 6,198,647 B1 | | 3/2001 | Zhou et al. | |

FOREIGN PATENT DOCUMENTS

| | | | |
|---|---|---|---|
| DE | 2047901 | 4/1972 | |
| DE | 295 02 296.5 | 5/1995 | |
| EP | 0 068 745 | 1/1983 | |
| EP | 0 245 083 A1 | 11/1987 | |
| EP | 0 594 031 A1 | 4/1994 | |
| WO | WO 01/35623 A1 * | 5/2002 | ..... H04M/7/04 |

OTHER PUBLICATIONS

Japanese Abstract, 11102819 A, Date of Publication Apr. 13, 1999.

Japanese Abstract, 07183126 A, Date of Publication Jul. 21, 1995.

Japanese Abstract, 10321444 A, Date of Publication Dec. 4, 1998.

Patentanmeldung, St 6381 VIIIc/21g, Jan. 12, 1956.

Japanese patent abstract, Publication No. 60206122, Publication Date Oct. 17, 1985.

* cited by examiner

*Primary Examiner*—Elvin Enad
*Assistant Examiner*—Jennifer A. Poker
(74) *Attorney, Agent, or Firm*—Schiff Hardin & Waite

(57) ABSTRACT

A ferrite core, such as for transformers, has a middle bleb with an oval cross-section or flattened oval cross-section, whereby the longitudinal axis of the middle bleb is oriented parallel to the attachment plane of the transformer and the longest axis of the oval cross-section or flattened oval cross-section is oriented vertically to this attachment plane. The core is symmetrically structured with respect to a mirror plane, which contains the longitudinal axis of the ferrite core and which resides vertically to the attachment plane, and is particularly low in distortion.

13 Claims, 2 Drawing Sheets

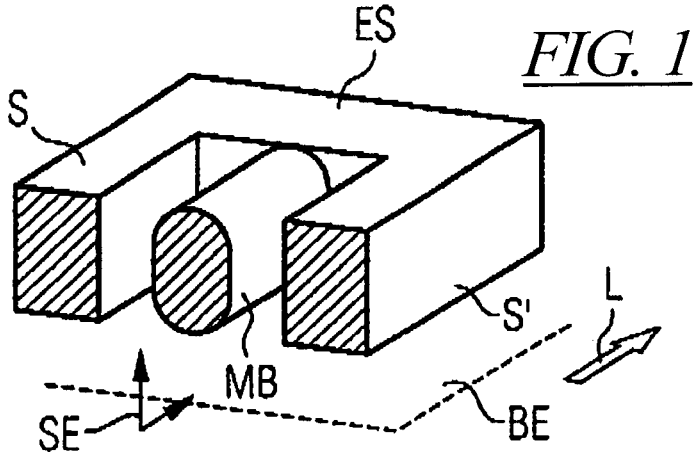
FIG. 1
FIG. 2A
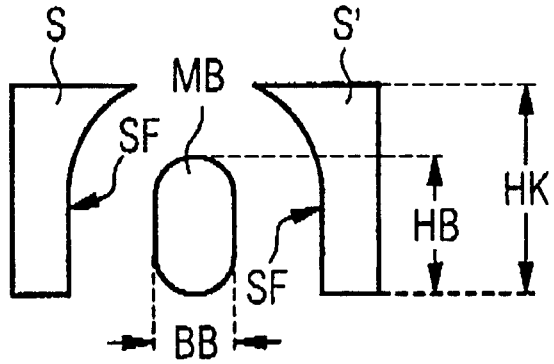
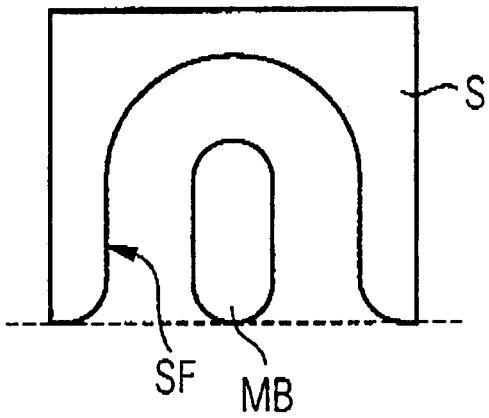
FIG. 2B

FERRITE CORE FOR A TRANSFORMER

BACKGROUND OF THE INVENTION

1. Field of the Invention

The present invention is directed to ferrite cores in transformers and in particular to the configuration of these cores as related to their functionality.

2. Description of the Related Art

Ferrite cores can be applied in various ways in telecommunications and data technology. Specific material core combinations are required for data transmission standards such as xDSL or ISDN, since the properties of components having ferrite components are essentially dependent on the material and on the core shape of the ferrite core.

For example, ferrite cores are applied as broadband transformers for impedance adaptations, as splitters for separating the speech and data channel (POTS=Plain Old Telephone Service) or as a signal pulse transformer in digital telecommunication networks, in which digital signals or analog signals are transmitted with little distortion. The number of required components is increasingly rising in modem terminal devices of the telecommunication. At the same time, a further reduction of assemblies and modules is desired in order to further reduce the size and weight of the terminal devices and in order to thus improve the handling. Corresponding assemblies and modules therefore have a continuously increasing packing density of the components. It is also desired to increase the packing density by selecting such components requiring less assembly surface on a base, such as a motherboard. Despite the minimization of the component measurements, performance and properties of the components are not to be impaired.

An EP13 ferrite core is currently the standard shape for xDSL transformers. Its behavior is good for a transmission with little distortion, an EP13 core has a beneficial core distortion factor, in particular. It represents a suitable variable for evaluating the distortion behavior and the nonlinear distortion factor. In order to reduce the surface need of the ferrite core, smaller cores than the EP13 core can be used, particularly standard shapes such as EP10 cores and EP7 cores. As a result of the reduced size, these cores also have a smaller middle bleb, which leads to a significantly higher core distortion factor for the component and therefore reduces the performance of the component and its suitability for data transmissions.

SUMMARY OF THE INVENTION

An object of the present invention is to provide a new shape for a ferrite core, which has a sufficiently good distortion behavior when the assembly surface is reduced and which has an improved core distortion factor compared to an equally sized core of a standard shape.

The present ferrite core is similar to the standard shaped EP core in that it is composed of two core halves with a parting seam extending vertically to the assembly surface/attachment surface. The present ferrite core represents an intermediate form between an E-core and a shell core. Parallel to the attachment surface and the longitudinal axis, it has a middle bleb flanked by two side parts at both sides. An end piece that is transversely arranged relative to the longitudinal axis of the middle bleb connects middle bleb and side parts such that the bottom edges of middle bleb and side parts are arranged in a plane, which is parallel to the attachment plane. The core has a plane of symmetry vertically residing relative to the attachment plane and comprising the longitudinal axis. In contrast to known EP cores, the inventive ferrite core has a middle bleb with an oval cross-section or flattened oval cross-section, whose longest extent resides vertically to the attachment surface.

In a preferred embodiment of the invention, the inwardly facing surfaces of the side parts follow the oval cross-section or flattened oval cross-section of the middle bleb at a predominately constant distance and form a hollow space for accepting the winding body.

In contrast to a comparable standard shape having the same assembly surface, the performance of the inventive ferrite core is improved. This means that an inventive ferrite core can replace a ferrite core having a larger assembly surface with only insignificant losses given almost equal properties. On the basis of an inventive ferrite core, components allowing a higher packing density can be produced.

The ferrite core can be fashioned as a standard EP core regarding its outer measurements and can have a rectangular base parallel to the attachment plane. The hollow space between the middle bleb and the side parts, which serves the purpose of accepting a coil body with at least one winding, is partially shielded by the side parts. The side parts therefore have a greater height above the attachment plane than the middle bleb. The hollow space formed by the side parts is preferably not completely closed toward the top and has a maximum opening toward the bottom relative to the attachment plane, whereby the opening corresponds to the maximum diameter of the hollow space.

Several advantages are obtained by an inventive ferrite core when the cross-section of the middle bleb is higher and wider. Preferably, the longest diameter of the oval cross-section or flattened oval cross-section, which is vertically oriented relative to the attachment plane, corresponds to at least the 1.2-times of the shortest diameter measured parallel relative to the attachment plane. Inventive ferrite cores can have a middle bleb, whose cross-section has principal axes or, respectively, diameters that differ up to the factor 5.

An inventive ferrite core has a closed magnetic circuit, however, it is divided into two or is fashioned from two core halves that are combined to an overall core along a parting seam in order to facilitate the installation of the coil body or the winding. The complete ferrite core thereby preferably consists of two mirror-inverted halves, whose symmetry plane resides vertically to the attachment plane and vertically to the longitudinal axis. However, it is also possible to divide the ferrite core such that the middle blebs and side parts completely belong to one core half, whereas the second "core half" is only composed of a further end piece connecting the free ends of the middle blebs and side parts to one another. However, it is also possible to provide the parting seam of the inventive ferrite core at an arbitrary location transverse to the longitudinal axis, whereby core halves of different size arise.

For producing a transformer from the inventive ferrite core, a coil body with preferably two windings is pushed over the middle bleb and the magnetic circuit is closed by joining the two core halves. The coil body can also have fastening pins and contacting pins, which can serve the purpose of connecting the winding ends and of producing the electrical contact with the printed circuit board or with the module substrate. Holding parts such as straps, clamps or caps can assure that the core halves are held together.

The core can be provided with an air gap at the middle bleb or may be formed without an air gap and can be produced from different ferrite materials. The ferrite materials T38, T42, N26 and T55 which are known from the EPCOS data book are particularly preferred for forming cores used in signal transmissions.

The application of inventive ferrite cores, however, it not limited to the transmission of signals. They can also be used as power transformers and are also characterized by their good performance given an improved or, respectively, smaller assembly surface.

BRIEF DESCRIPTION OF THE DRAWINGS

The invention is subsequently explained in greater detail on the basis of exemplary embodiments and the appertaining Figures.

FIG. 1 schematically shows a ferrite core according to the present invention.

FIGS. 2*a* and 2*b* show inventive ferrite cores in a schematic cross-section.

DETAILED DESCRIPTION OF THE PREFERRED EMBODIMENT

Figure 3:
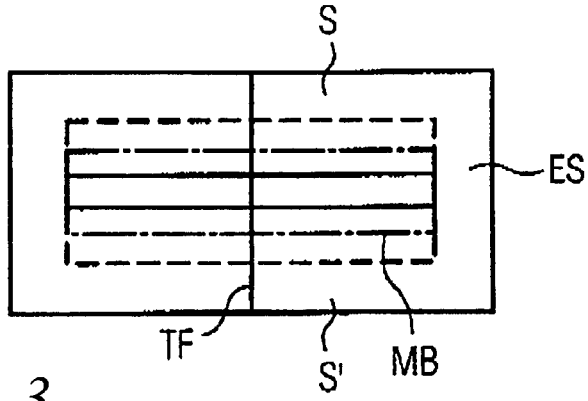
FIG. 3 shows a ferrite core in plan view from above.

FIG. 1 shows an inventive ferrite core, wherein a middle bleb MB and two side parts are oriented parallel to a longitudinal axis L. An end piece ES connecting the side parts S, S' and the middle bleb MB is transversely arranged relative to the longitudinal axis. The entire core is fashioned mirror-inverted relative to a mirror plane SE, which extends through the center of the middle bleb and which contains the longitudinal axis L and which transversely resides relative to the attachment plane. The lower edges of the side parts S, S' and the middle bleb MB are situated on a plane parallel to the attachment plane BE. The middle bleb MB has an oval cross-section or flattened oval cross-section (a shape as shown in the drawings with semicircular ends and flat sides), whose longest extent is vertically oriented relative to the attachment plane BE. The height of the side parts S and of the middle bleb MB is the same in the selected exemplary embodiment, but does not constitute a condition for inventive cores.

FIGS. 2*a* and 2*b* show further exemplary embodiments of inventive cores in a schematic cross-section transverse to the longitudinal axis L. FIG. 2*a* shows an embodiment, wherein the height HK of the side parts S, S' is greater than the height HB of the middle bleb. In contrast to the simplest exemplary embodiment shown in FIG. 1, the side surfaces SF of the side parts S, S' facing the middle bleb are bent and follow the bend of the middle bleb MB with a correspondingly elongated radius of curvature. The side parts S, S' correspondingly include a hollow space, whose inside surfaces follows the surface of the middle bleb and is correspondingly approximately oval or flattened oval shaped. The hollow space, which is formed by the side parts and which has a half-oval cross-section or half flattened oval cross-section, however, is not entirely closed on top and has a maximum opening toward the attachment plane BE. The ratio HB to BB, therefore the ratio of the height of the middle bleb to the width of the middle bleb is situated between 1, 2 and 4 with respect to the inventive ferrite core.

FIG. 2*b* shows a ferrite core in schematic cross-section with a higher ratio HB to BB compared to FIG. 2*a*. Moreover, the two side parts S are upwardly extended such that the hollow space enclosed by the side parts above the middle bleb is closed toward the top.

FIG. 3 shows an inventive ferrite core in plan view. A complete ferrite core has a closed magnetic circuit, whereby two core halves are inventively required therefor. In FIG. 3, two identical core halves are united along a parting seam TF to an overall core such that it has a further mirror plane parallel to the parting seam TF in addition to the aforementioned mirror plane SE along the longitudinal axis L. The core shown in plan view corresponds to the core shown in FIG. 2*a*, wherein the width of the middle bleb MB (represented in broken lines in the Figure) is larger than the opening of the two side parts S, S' facing upward. In addition to the shown symmetric dividing of the two core halves, it is possible to close the magnetic flow within one of the shown core halves not by an identical second core half but by a corresponding further end piece ES. All other unsymmetric dividing, wherein the two "core halves" have differently long side parts S and middle blebs MB, is certainly possible as well. For symmetry reasons, the symmetric dividing shown in FIG. 3 is preferred.

Figure 4:
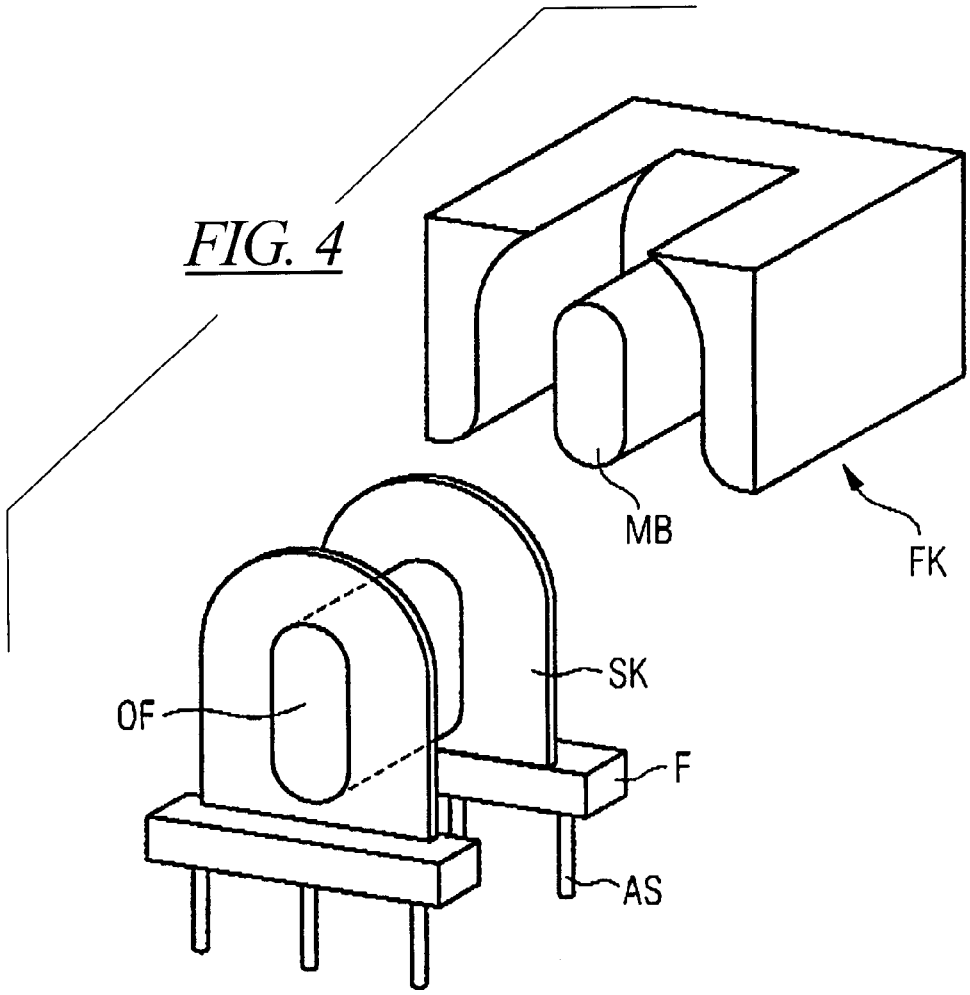
FIG. 4 shows a ferrite core with an appertaining coil body.

FIG. 4 schematically shows the corresponding core. A coil body SK is shown, which is separated from the ferrite core and which is pushed over the middle bleb and which serves the purpose of accepting a winding. For this purpose, the coil body SK has an opening OF corresponding to the cross-section of the middle bleb. The coil body has flanges F at the lower end, in which connection pins AS are fastened. The connection pins AS serve the purpose of connecting the windings arranged on the coil body SK and of fastening the overall arrangement composed of coil body, winding and ferrite core, for example a transformer.

For estimating the distortion behavior of an inventively fashioned ferrite core FK (as shown in FIG. 4), the geometry-related core distortion factor is calculated and compared with the corresponding values of the known standard shapes EP10 and EPI3. A ferrite core FK having the outer measurements of the standard shape EP10 is produced, which has the inventive flattened oval middle bleb MB. The characteristic values of the inventive EPX10 core cited ferrite core are contrasted with the values of the comparable standard shape EP10 and with the values of the next larger standard shape EP13.

| | EP 13 | EPX10 | EP10 |
|---|---|---|---|
| a [mm] | 12.5 | 11.5 | 11.5 |
| b [mm] | 8.8 | 7.6 | 7.6 |
| h1 [mm] | 12.85 | 10.20 | 10.20 |
| $V_{assembly}$ [$mm^3$] | 1413 | 890 | 890 |
| $l_e$ [mm] | 24.2 | 21.5 | 19.2 |
| $A_e$ [$mm^2$] | 19.5 | 15.1 | 11.3 |
| $A_{min}$ [$mm^2$] (bleb) | 14.9 | 13.2 | 8.55 |
| $A_{max}$ [$mm^2$] (wall) | 49.0 | 31.2 | 37.8 |
| $l_N$ [mm] | 23.8 | 24.3 | 21.5 |
| $A_N$ [$mm^2$] | 13.8 | 11.4 | 11.4 |
| CDF [$mm^{-4,5}$] | 0.191 | 0.333 | 0.506 |

In the table, a and b stand for externally measured width and height of the ferrite core, h1 for the length, $V_{assembly}$ for the outside volume, $l_e$ for the effective magnetic wavelength of the ferrite core, $A_e$ for the effective magnetic cross-section of the ferrite core, $l_N$ for the average winding length of the coil body and $A_N$ for the winding cross-section of the coil body. The core distortion factor CDF is calculated corresponding to a method presented on the MMPA User Conference, Chicago, September 1997 according to $$CDF = \sum_i \frac{l_i}{l_e} \cdot \frac{1_N^{3/2}}{A_N^{3/2}} = \frac{1_e}{A_e^2} \cdot \frac{1_N^{3/2}}{A_N^{3/2}}$$

It shows that the inventive EPX10 core shows a significantly improved magnetic behavior and particularly a significantly improved core distortion factor—from 0.506–0.333 given the same outer measurements as an EP10 core. The low CDF of the EPX10 core therefore is close to the next larger standard shape EP13. It is thus clear that the shape and particularly the required assembly surface can be inventively reduced given the same magnetic values or the magnetic values of a ferrite core can be significantly improved given the same shape and particularly the same assembly surface. This allows higher integration densities on modules and printed circuit boards, which are equipped with inventive ferrite cores or with the components produced therefrom as transformed.

Although the invention is only shown on the basis of a few representative exemplary embodiments, it is also within the framework of the invention to vary the core shape in a different way without deviating from the inventive idea. In particular, there are no limits with respect to the outside shape of the ferrite core, namely the shape of the side parts. However, the shown cubic outside shape has the advantage that it leads to ferrite cores having the best magnetic behavior regarding the given outside volume. The cubic outer measurements of inventive ferrite cores is also preferred with respect to the space optimization given the installation, since it represents the most compact shape.

Although modifications and changes maybe suggested by those skilled in the art, it is the intention of the inventor to embody within the patent warranted hereon all changes and modifications as reasonably and properly come within the scope of his contribution to the art.

What is claimed is:

1. A ferrite core for a low-distortion transformer, comprising:

a horizontal middle element having an oval cross-section or flattened oval cross-section without corners, said oval cross-section or flattened oval cross-section having a longest diameter perpendicular to an attachment plane;

two lateral parts that flank said horizontal middle element at both sides in a symmetrical arrangement, said two lateral parts being a same length as said middle element for a ferrite core without an air gap or a same length as said middle element plus a width of an air gap ferrite core with an air gap, said two lateral parts extending with a respectively constant cross-section along a longitudinal axis of the ferrite core, said two lateral parts comprising inwardly directed surfaces that follow said middle element's oval cross-section or flattened oval cross-section at a largely constant spacing without entirely surrounding it, said inwardly directed surfaces forming a cavity configured to accept a wound body that is opened wide downwardly toward said attachment plane and is not completely closed or completely closed upward;

an end piece transversely arranged relative to said longitudinal axis, said end piece connecting said middle element and said two side parts such that lower edges of said middle element and lower edges of said side parts are situated in a plane parallel to said attachment plane; and said ferrite core being symmetrically structured with respect to a mirror plane that contains said longitudinal axis, said mirror plane being perpendicular to said attachment plane.

2. A ferrite core according to claim 1, wherein the side part flanks above the attachment plane are taller than the middle element.

3. A ferrite core according to claim 1, wherein the cavity has a maximum opening toward a bottom substantially adjacent the attachment plane and is substantially closed toward a top spaced away from the attachment plane.

4. A ferrite core according to claim 1, wherein the cavity has a maximum opening toward a bottom substantially adjacent the attachment plane and is entirely closed toward a top spaced away from the attachment plane.

5. A ferrite core according to claim 1, wherein the ferrite core is being fashioned as an EP core with a rectangular circumference parallel to the attachment plane and cubic outside measurements.

6. A ferrite core according to claim 1, wherein the longest diameter of the oval cross-section or flattened oval cross-section is a multiple of a shortest diameter of the oval cross-section, said multiple being within a range of 1.2 to 5.

7. A transformer, comprising:

a ferrite core including two side part flanks and a middle element, said two side part flanks being in a symmetrical arrangement on both sides of said ferrite core;

in a ferrite core type without an air gap said two side part flanks having a same length as said middle element;

in a ferrite core type with an air gap said two side parts flanks having a length that differs from the length of said middle element by a width of said ferrite core;

each of said two side part flanks extending along a longitudinal axis of said ferrite core with a respectively constant cross-section;

an end piece transversely arranged relative to the longitudinal axis, said end piece connecting said middle element and said two side part flanks such that lower edges of said middle element and said side part flanks are situated in a plane parallel to an attachment plane;

said middle element having an oval cross-section or flattened oval cross-section without corners, said oval cross-section or flattened oval cross-section having a longest diameter perpendicular to the attachment plane;

said ferrite core being symmetrically structured with respect to a mirror plane that contains the longitudinal axis, the mirror plane being perpendicular to the attachment plane, a magnetic circuit in the ferrite core being closed; and a coil body with at least one winding being arranged about said middle element.

8. A transformer according to claim 7, wherein said ferrite core is a first ferrite core, and further comprising:

a second ferrite core having a substantially similar structure as said first ferrite core, the magnetic circuit being closed with said first and second ferrite cores as two core halves.

9. A transformer according to claim 7, further comprising:

a further end piece which closes the magnetic circuit.

10. A transformer according to claim 7, wherein the transformer is being utilized as a transformer for an impedance adaptation and for an insulation during an xDSL application.

11. A transformer according to claim 7, wherein the ferrite core has an outer measurements of an EP 10 core.

12. The ferrite core according to claim 1, wherein a parting seam is provided in said ferrite core at an arbitrary location transverse to said longitudinal axis so that core halves of different respective sizes are formed.

13. A ferrite core for a small footprint transformer, comprising:

a middle element having a flattened oval cross-section, said flattened oval cross-section having a longest dimension in the cross-section perpendicular to an attachment plane;

two lateral parts that flank said middle element at both sides in a plane parallel to the attachment plane so as to form a symmetrical arrangement, said two lateral parts being a same length as said middle element for a ferrite core without an air gap or a same length as said middle element plus a width of an air gap for a ferrite core with an air gap, said two lateral parts extending with a respectively constant cross-section along a longitudinal axis of the ferrite core, said two lateral parts comprising inwardly directed surfaces that follow said middle element's flattened oval cross-section at a largely constant spacing without entirely surrounding it, said inwardly directed surfaces forming a cavity configured to accept a wound body that is opened wide downwardly toward said attachment plane and is not completely closed or completely closed upward;

an end piece transversely arranged relative to said longitudinal axis, said end piece connecting said middle element and said two side parts such that lower edges of said middle element and lower edges of said side parts are situated in a plane parallel to said attachment plane; and said ferrite core being symmetrically structured with respect to a mirror plane that contains said longitudinal axis, said mirror plane being perpendicular to said attachment plane.

* * * * *